US009856707B2

(12) United States Patent
Bracken

(10) Patent No.: US 9,856,707 B2
(45) Date of Patent: Jan. 2, 2018

(54) CAPILLARY INJECTION DELIVERY SYSTEM HAVING TUBING ANCHOR

(71) Applicant: Weatherford/Lamb, Inc., Houston, TX (US)

(72) Inventor: James Bracken, Addison, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 685 days.

(21) Appl. No.: 14/248,941

(22) Filed: Apr. 9, 2014

(65) Prior Publication Data

US 2014/0305633 A1 Oct. 16, 2014

Related U.S. Application Data

(60) Provisional application No. 61/810,583, filed on Apr. 10, 2013.

(51) Int. Cl.

| | |
|---|---|
| ***E21B 23/01*** | (2006.01) |
| ***E21B 23/00*** | (2006.01) |
| ***E21B 17/10*** | (2006.01) |

(52) U.S. Cl.

CPC ..... *E21B 23/006* (2013.01); *E21B 17/1035* (2013.01); *E21B 23/004* (2013.01); *E21B 23/01* (2013.01)

(58) Field of Classification Search

CPC ..... E21B 23/004; E21B 23/006; E21B 23/01; E21B 17/1035; E21B 17/026

See application file for complete search history.

(56) References Cited

U.S. PATENT DOCUMENTS

| | | | | |
|---|---|---|---|---|
| 1,869,759 | A | 4/1929 | Lynch | |
| 4,605,063 | A * | 8/1986 | Ross | E21B 23/01 166/216 |
| 5,148,866 | A * | 9/1992 | Greenlee | E21B 33/1292 166/134 |
| 6,712,141 | B1 | 3/2004 | Bussear et al. | |
| 7,708,075 | B2 | 5/2010 | Lake et al. | |

(Continued)

OTHER PUBLICATIONS

First Office Action in counterpart Canadian Appl. 2,848,563, dated Aug. 25, 2015.

(Continued)

*Primary Examiner* — David L Andrews
*Assistant Examiner* — Tara E Schimpf
(74) *Attorney, Agent, or Firm* — Blank Rome LLP

(57) ABSTRACT

A capillary injection system delivers chemical with a capillary string to a targeted area in a wellbore such as adjacent a rod pump of a reciprocating pump system. The capillary string is disposed along the production string and delivers the chemical downhole. A tubing anchor disposed on the production string anchors the production string in tension in the casing. The tubing anchor has a mandrel coupled to the production string and has a housing disposed on the mandrel. The mandrel accommodates the capillary string outside thereof and defines a guide slot for controlling relative movement of the mandrel and the housing engaged with the guide slot. The housing has a slip movable outward from the mandrel. The mandrel is in a set condition is moved axially in the guide slot, and the slip is moved outward from the mandrel against the casing.

17 Claims, 8 Drawing Sheets

(56) References Cited

U.S. PATENT DOCUMENTS

| | | | | |
|---|---|---|---|---|
| 2004/0040718 | A1* | 3/2004 | Rhodes | E21B 34/08 166/325 |
| 2014/0166313 | A1* | 6/2014 | Moore | E21B 23/01 166/382 |

OTHER PUBLICATIONS

Weatherford, "'BA' Tubing Anchor Catcher," Product Brochure, copyright 2000.
Wagener, J., "Weatherford: East Texas SPE Meeting," dated Oct. 11, 2011.
Weatherford, "Type R: Tubing Anchor Catcher," Product Brochure, copyright 2007.
Weatherford, "'BA' Tubing Anchor Catcher," Product Brochure, copyright 2007.

* cited by examiner (BACKGROUND)

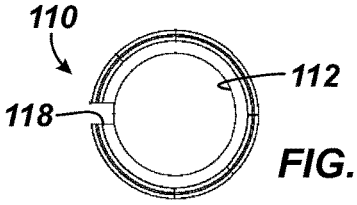
FIG. 6C
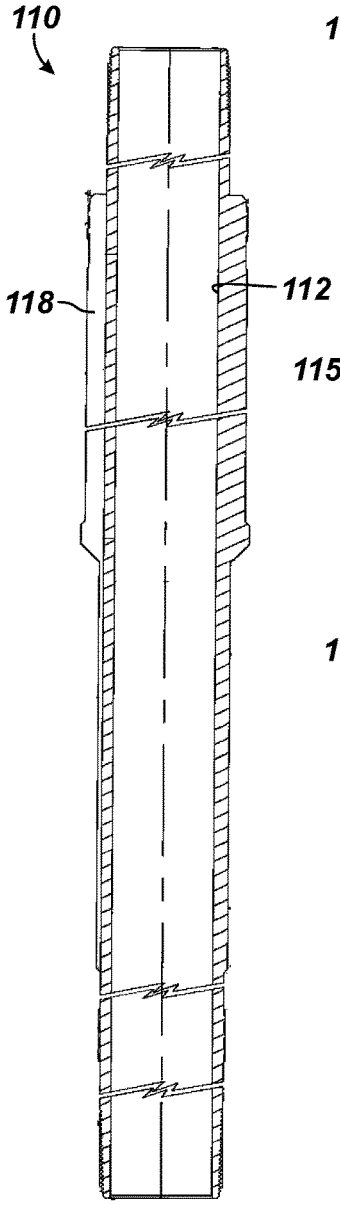
FIG. 6A
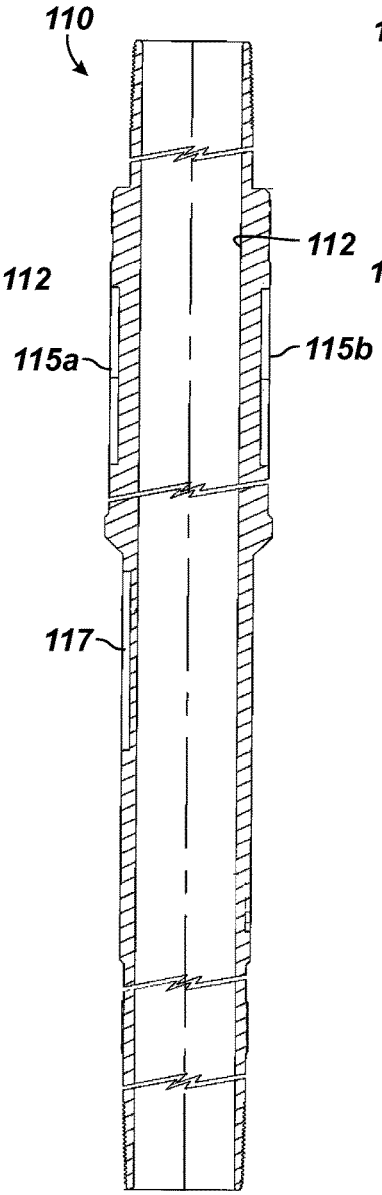
FIG. 6B
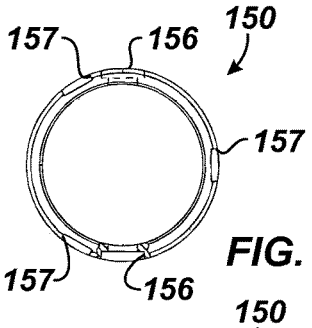
FIG. 7B
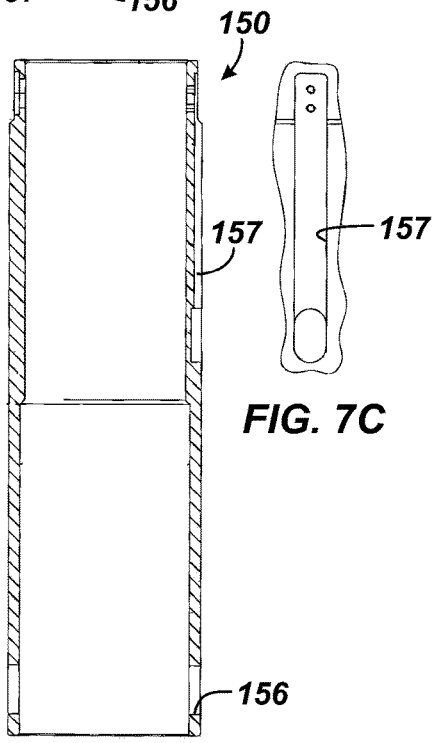
FIG. 7C
FIG. 7A

CAPILLARY INJECTION DELIVERY SYSTEM HAVING TUBING ANCHOR

CROSS-REFERENCE TO RELATED APPLICATIONS

This application claims the benefit of U.S. Prov. Appl. 61/810,583, filed 10 Apr. 2013, which is incorporated herein by reference in its entirety.

BACKGROUND OF THE DISCLOSURE

Reciprocating pump systems, such as sucker rod pump systems, extract fluids from a well and employ a downhole pump connected to a driving source at the surface. A rod string connects the surface driving force to the downhole pump in the well. When operated, the driving source cyclically raises and lowers the downhole pump, and with each stroke, the downhole pump lifts well fluids toward the surface.

For example, FIG. 1 shows a sucker rod pump system 10 used to produce fluid from a well. A downhole pump 14 has a barrel 16 with a standing valve 24 located at the bottom. The standing valve 24 allows fluid to enter from the wellbore, but does not allow the fluid to leave. Inside the pump barrel 16, a plunger 20 has a traveling valve 22 located at the top. The traveling valve 22 allows fluid to move from below the plunger 20 to the production tubing 18 above, but does not allow fluid to return from the tubing 18 to the pump barrel 16 below the plunger 20. A driving source (e.g., a pump jack 11) at the surface connects by a rod string 12 to the plunger 20 and moves the plunger 20 up and down cyclically in upstrokes and downstrokes.

During the upstroke, the traveling valve 22 is closed, and any fluid above the plunger 20 in the production tubing 18 is lifted towards the surface. Meanwhile, the standing valve 24 opens and allows fluid to enter the pump barrel 16 from the wellbore. At the top of stroke (TOS), the standing valve 24 closes and holds in the fluid that has entered the pump barrel 16. During the downstroke, the traveling valve 22 initially remains closed until the plunger 20 reaches the surface of the fluid in the barrel 16. Sufficient pressure builds up in the fluid below the traveling valve 22 to balance the pressure. After the pressure balances, the traveling valve 22 opens and the plunger 20 continues to move downward to its lowest position to fill the pump 14. The reciprocating process is repeated to lift fluid in the tubing.

In many applications, such as in reciprocating pump systems noted above, operators may want to inject chemicals to assist in the control of corrosion, water, scale, paraffin, salt, and Hydrogen Sulfide ($H_2S$) in the production tubing. One way to inject chemicals uses a capillary injection system, which can deliver the chemicals downhole using a capillary string. In addition to controlling buildup and the like, the capillary injection system can be used to inject a lifting chemical to offset a reduction in bottom hole pressure (BHP) that typically occurs as a hydrocarbon reservoir is produced.

Chemical injections have been developed to mitigate or eliminate these difficulties. For example, surfactants are commonly injected into wells to de-water them. Other chemicals are used to counter the effects of emulsions and precipitates and to provide corrosion protection. If the well is untreated, it is well known that corrosive materials can rapidly degrade wellbore components, such as sucker rods.

Of course, if these components must be replaced, the non-productive time for the well will result in lost or slowed production.

Spoolable tubing has been used for delivering the above mentioned chemicals. Examples of spoolable tubing are capillary tubing and coiled tubing. FIG. 2A shows a bottom hole assembly of the prior art in which chemicals are delivered with a capillary string S. Briefly, the well has casing C with perforations at a production zone. A production string T having threadably interconnected joints extends from a wellhead (not shown) at the surface to a tubing anchor 40 and a reciprocating rod pump P. The tubing anchor 40 anchors the production string T in the casing C and allows the production string T to be held in tension in the wellbore. This has a number of known advantages.

Below the tubing anchor 40, the assembly has the sucker rod pump P and may have a perforated sub (not shown). The sucker rod pump P is connected to a sucker rod string R extending through the production tubing T to the surface. As already noted, reciprocation of the string R axially reciprocates the pump P to transport fluids from the formation through the production tubing T to the surface.

To deliver chemicals downhole, the capillary string S extends from the wellhead (not shown) at the surface and along the tubing T. The capillary string S is typically banded to the production tubing T with various bands. Eventually, the capillary string S terminates at the production tubing T uphole of the tubing anchor 40, where injected chemicals are delivered.

In FIG. 2B, the production tubing T has a gas lift mandrel M with or without a valve (not shown) disposed above the tubing anchor 40. The capillary string S passes down to the gas lift mandrel M. At this point, the end of the capillary string S terminates at the mandrel M so chemicals can be injected internally into the production tubing T through the mandrel M uphole of the tubing anchor.

These traditional treatment methods in FIGS. 2A-2B simply inject chemicals uphole of the rod pump P. In general, these methods can achieve a poor ratio of how much treatment is applied compared to how much treatment is effectively delivered as needed. In FIG. 2A, chemicals are lost and do not reach the rod pump P. In FIG. 2B, the rod pump P, tubing anchor 40, and lower portion of the production tubing T are not sufficiently treated.

To improve the chemical injection, it has been proposed in the prior art to extend the end of the capillary string past the tubing anchor and closer to the inlet of the rod pump. For example, FIG. 2C illustrates a capillary injection system according to the prior art for injecting chemicals below a tubing anchor 40 near a subsurface reciprocating pump P. With this arrangement, the delivered chemicals from the capillary string S can enter the tubing string T through the rod pump R, which has a number of benefits. The primary issue then is how to pass the capillary string S past the tubing anchor 40, which is used to support the production tubing T in tension inside the casing as the reciprocating rod R operates the rod pump P.

As disclosed in U.S. Pat. No. 4,605,063, a solution has been proposed in the prior art in which a capillary string is simply passed through a conventional tubing anchor. Referring to FIG. 3, a tubing anchor 40 is connected to a production string (not shown). The anchor 40 has radially expandable slips 50, which are shown engaged with the casing C. A capillary string 30 extends from the surface to the tubing anchor 40 and can be attached to the tubing with bands (not shown). Past the anchor, the capillary string 30 extends to a subsurface position a sucker rod pump (See FIG. 2C).

The tubing anchor 40 is incorporated into the production string to prevent vertical movement of the tubing string. The tubing anchor 40 has an axially extending tubular body 41 conventionally attached to the tubing T by upper and lower threaded couplings 43*a*-*b*. The tubular body 41 has upper and lower threads 41*a*, 41*c* adjacent its upper and lower ends. The upper threads 41*a* are of an opposite hand from the lower threads 41*c*. At least one axially extending groove 41*b* is located along the exterior surface of the tubular body 41 and extends through both the upper and lower threads 41*a* and 41*c*. Although not shown, the groove 41*b* has a dovetail cross-sectional configuration.

An upper conical expander 42 has inner threads 42*a* engagable with the tubular body's upper threads 41*a*, and the expander 12 is positioned concentrically around tubular body 41 adjacent threads 41*a*. The expander 42 has a downwardly facing conical surface 42*c*. A similar lower expander 52 has an upwardly facing conical surface 52*a*. This lower expander 52 has internal threads 52*c* and is located adjacent the lower end of the tubular body 41. The internal threads 52*c* are nonfunctional after assembly. In a retracted position (not shown), the threads 52*c* are not in engagement with the body's lower threads 41*c*.

The anchoring slips 50 are positioned concentrically encircling the tubular body 41 between the upper and lower expanders 42 and 52. When expanded against the casing, the anchoring slips 50 can securely engage to prevent vertical movement in either direction. The anchoring slips 50 are received within openings or windows 44*a* defined within an exterior tubular housing 44 encircling the expanders 42 and 52 and the tubular body 41. Coil springs 60 extend circumferentially between adjacent anchoring slips 50 and inwardly bias the anchoring slips 50 to retracted positions.

A torque pin 62 attached to the lower expander 52 extends through an axially extending slot 44*b* located in the outer housing 44. The torque pin 62 thus rotationally secures the outer housing 44 to the lower expander 52, and the windows 44*a* rotationally secure each radially expandable anchoring slip 50 to the outer housing 44. The lower expander 52 is attached to the expander sleeve 66 with shear pins 64. Sleeve 66 has threaded connections 66*c* on its interior engagable with the lower threads 41*c* located on the tubular body 41. Rotation of tubular body 41 will therefore cause movement of the expander sleeve 66 and the lower expander 52 relative thereto.

A nut assembly 46 and 48 secures the outer housing 44 to the tubular body 41. A flexible drag spring 56 is secured to the tubular housing 44 by means of conventional screws 58. The drag spring 56 is outwardly biased and engages the casing C to prevent rotation of the outer housing 44 relative to the casing C. Thus, rotation of the upper and lower expanders 42 and 52 and the anchoring slips 50 relative to the casing is resisted by drag spring 56.

To secure the tubing anchor 40 and the tubing T with respect to the casing C, the tubing T can be rotated thus imparting rotation to the tubular body 41. Rotation of tubular body 41 occurs while the upper expander 42 is rotationally restrained by the outer housing 44 and by the drag springs 56. Therefore, the threads 41*a* and 42*a* move the upper expander 42 axially relative to the anchoring slips 50. The slips 50 and the tubular housing 44 are initially moved downwardly relative to tubular body 41.

Eventually, the lower expander 52 moves downwardly into engagement with the body's lower threads 41*c* whereupon continued rotation of tubular body 41 causes the lower expander 52 to move in the opposite direction toward the slip 50 and the upper expander 42. Continued rotation shifts the upper and lower expanders 42, 52 toward each other and ultimately expands the anchoring slips 50 outwardly into engagement with the casing C. Eventually, sufficient rotation is imparted to the tubular body 41 to fully expand the anchoring slips 50 and to prevent further axial movement of the tubing string T in either direction.

The tubing anchor 40 can be released by sufficient upward tension on the tubing string T to shear the shear pins 64 holding the lower expander 52 fixed relative to the tubular body 41. These shear pins 64 are chosen with a sufficient strength to prevent release under normal anticipated tensile loads.

Since the anchoring slips 50 are actuated by rotational movement of the tubular body 41 and the tubing string T, it will be apparent that the capillary string 30 attached to the tubing T will interfere with the normal expansion of the slips 50 since the capillary string 30 must move rotationally with the tubing T. As shown, a separate conduit or section of the capillary string 30 is provided with upper and lower conventional attachments for attachment to upper and lower sections of the capillary string. This intermediate section of the capillary string 30 comprises a separate section of flow line of the same type and diameter as that of the remainder of the string 30. The intermediate section of the capillary string 30 is received within the body's dovetail groove 41*b* and extends along the exterior of the tubular body 41 through the upper and lower expanders 42 and 52 and through the encircling anchoring slips 50. This groove 41*b* is sufficiently deep to permit the capillary string 30 be received therein without interfering with the threaded connections 41*a*-42*a* or 41*c*-52*c* of the expanders 42, 52. In this way, a path is provided for injection of fluids through the tubing anchor 40 to a subsurface location below the tubing anchor 40, such as adjacent perforations in the casing.

The tubing anchor 40 of FIG. 3 require multiple turns for the slips 50 to be expanded outward and set. In this respect, the tubing anchor 40 is similar to a conventional threaded anchor that requires 9 to 12 rotations to set the anchor with the threads (41*a* and 41*c*) in FIG. 3. As a consequence, the tubing anchor 40 requires the anchor to be "screwed" together to activate. In use then, it may not be effectively possible to pass the capillary string 30 through the anchor 40 and rotate the tubing T and capillary string 30 multiple times to set the anchor 40 without potentially causing damage to the capillary string 30. Additionally, configuring the shear pins 62 on the expander sleeve 66 to release the anchor 40 may be less than ideal because the expander sleeve 66 has a complicated arrangement in which the sleeve 66 is engaged with the body's lower thread 41*c*, with the lower expander 52, with the torque pin 62, and with the outer housing 44.

The subject matter of the present disclosure is directed to overcoming, or at least reducing the effects of, one or more of the problems set forth above.

SUMMARY OF THE DISCLOSURE

A capillary injection system for delivering a chemical to a targeted area in a wellbore has a production string, a control body or tubing anchor, and a capillary string. The capillary string has an injection valve on its distal end. The capillary string is fastened to at least a portion of the production string disposed in the wellbore. The tubing anchor is adapted to permit a portion of the capillary string to pass therethrough so the valve can deliver the flow of chemicals to a targeted area in the wellbore, such as at a rod pump on the production string.

In one implementations, the tubing anchor has a mandrel, a housing, and a slip holder. The mandrel is coupled to the production string and accommodates a portion of the capillary string outside thereof. The mandrel defines a first slot for the housing and defines a second slot for the slip holder. The mandrel also has a cone disposed thereon.

The housing is disposed on the mandrel about the capillary string and is engaged with the first slot. The holder is disposed on the housing and can rotate relative to the housing. The holder engaged with the second slot on the mandrel. Finally, the holder has a slip movable outward from the mandrel.

When the tubing anchor is in an unset condition, the mandrel has a first portion of the first slot engaged with the housing. The cone on the mandrel is positioned away from the slip so that the slip is not moved outward against the casing.

The tubing anchor can be set from the unset condition to a set condition by rotating the production tubing (and the mandrel by connection) less than a full turn (e.g., ¼ turn) and pulling tension on the production tubing (i.e., moving the mandrel axially uphole). When the tubing anchor is in the set condition, the mandrel is moved axially and less than the full turn from the first portion of the first slot relative to the housing. The holder is rotated relative to the housing, and the cone moves the slip outward against the casing.

The tubing anchor can be used in a lift system, such as a reciprocating rod pump, progressive cavity pump, plunger lift, or other system in which the production string is held in tension. The lift system can use an injection valve disposed on a distal end of the capillary string downhole of the tubing anchor.

The foregoing summary is not intended to summarize each potential embodiment or every aspect of the present disclosure.

BRIEF DESCRIPTION OF THE DRAWINGS

FIG. 6A-6C illustrate a first cross-sectional view, a second cross-sectional view, and an end view of a mandrel for the disclosed tubing anchor.

FIG. 7A-7B illustrates a cross-sectional view and an end view of an outer housing for the disclosed tubing anchor.

FIG. 7C is a detail of the outer housing showing a groove for a drag block spring.

DETAILED DESCRIPTION OF THE DISCLOSURE

Figure 1:
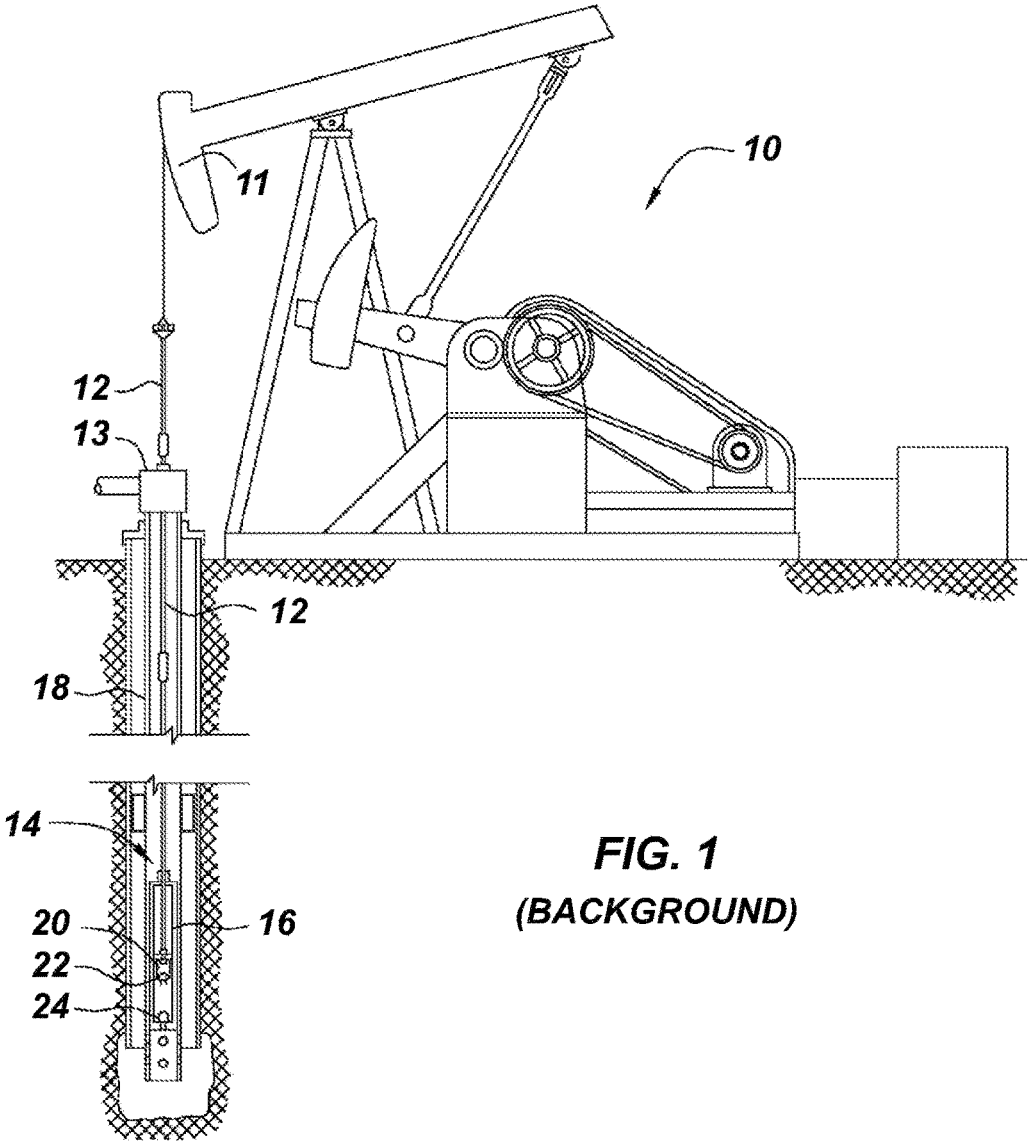
FIG. 1 illustrates a sucker rod pump system known in the art.
Figure 2C:
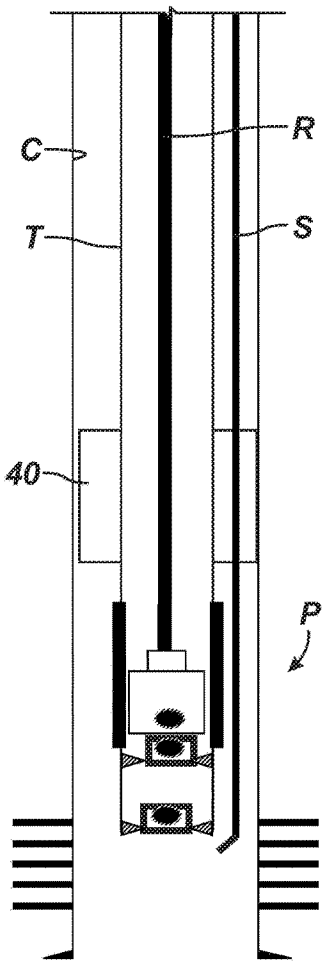
FIG. 2C (Prior Art)
FIG. 2C schematically illustrates a prior art capillary injection system terminating downhole of a tubing anchor.
Figure 2B:
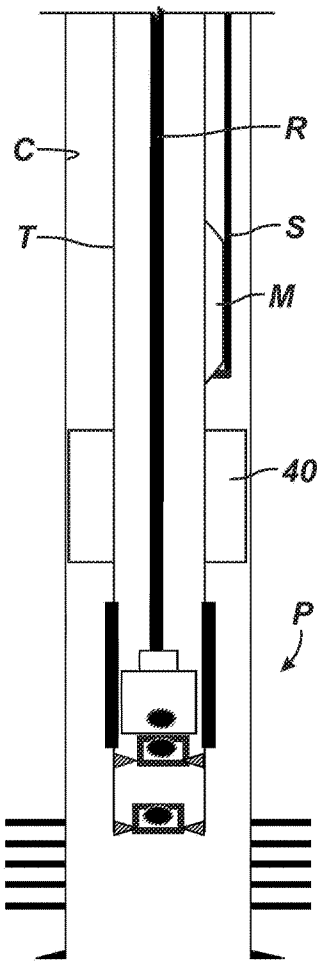
FIG. 2B (Prior Art)
FIG. 2B schematically illustrates a prior art capillary injection system terminating uphole of a tubing anchor at a gas mandrel.
Figure 2A:
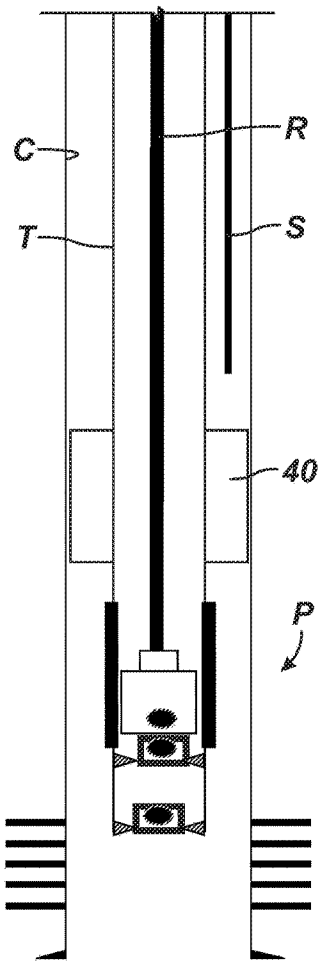
FIG. 2A (Prior Art)
FIG. 2A schematically illustrates a prior art capillary injection system terminating uphole of a tubing anchor.
Figure 3:
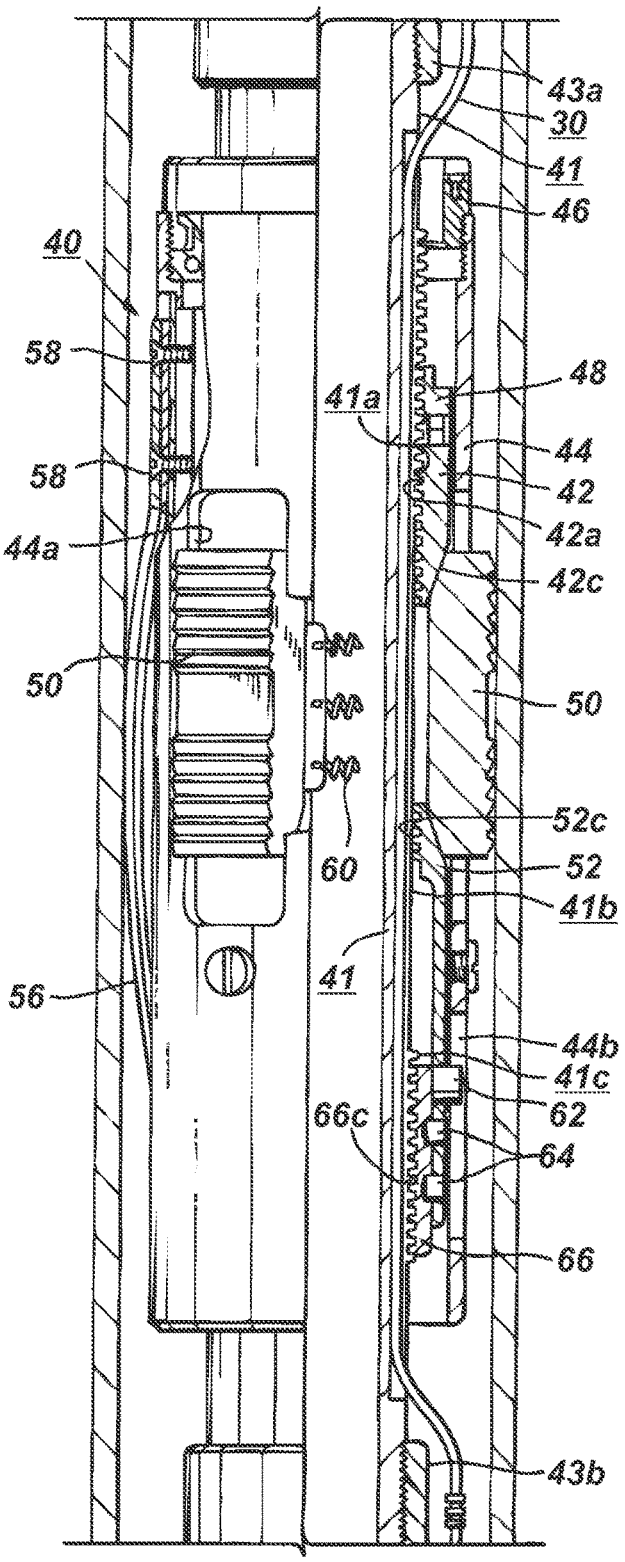
FIG. 3 (Prior Art)
FIG. 3 illustrates a prior art tubing anchor passing a capillary string further downhole of the anchor.
Figure 4A:
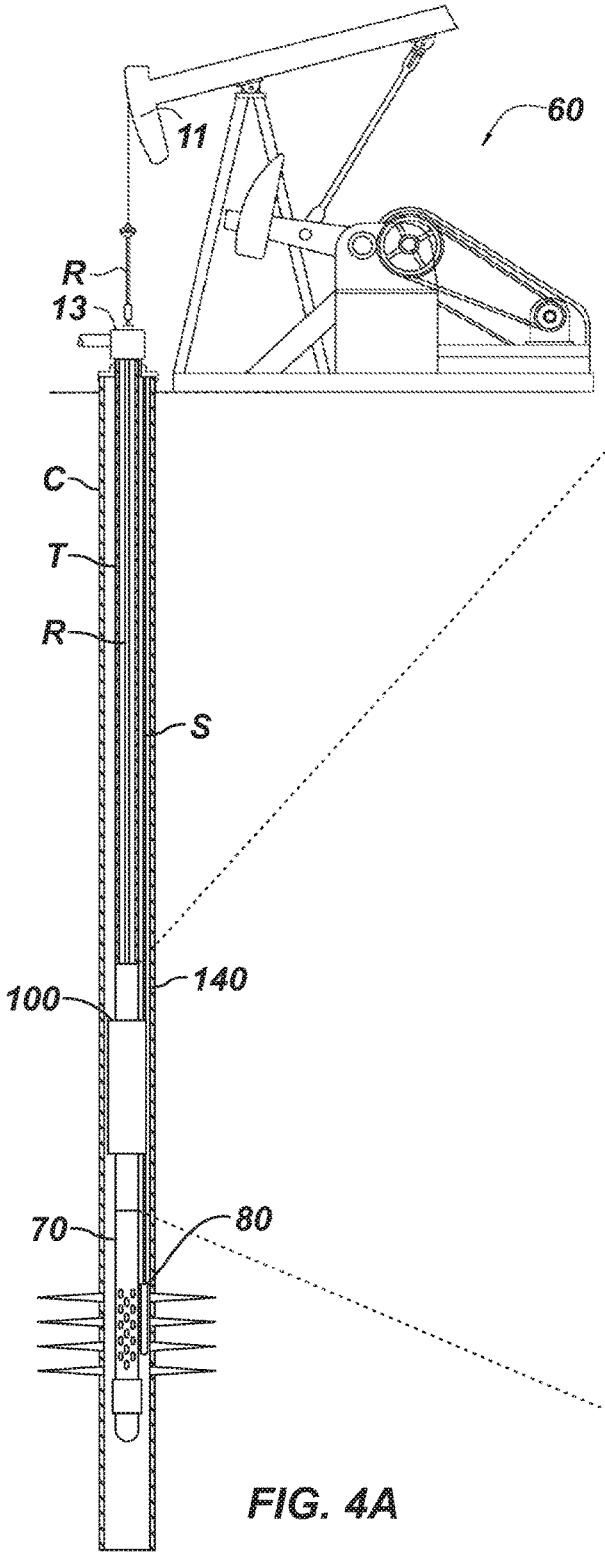
FIG. 4A illustrates a capillary injection system according to the present disclosure for a sucker rod pump.
Figure 4B:
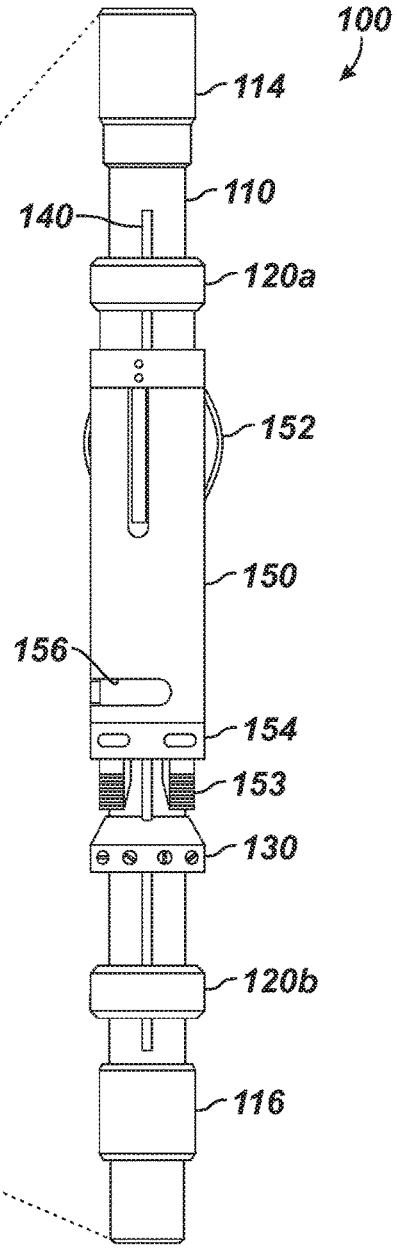
FIG. 4B illustrates the tubing anchor of the capillary injection system in more detail.

FIG. 4A illustrates a capillary injection system 60 according to the present disclosure for a sucker rod pump system, and FIG. 4B illustrates a tubing anchor 100 of the capillary injection system 60 in more detail. The components of the tubing anchor 100 can be composed of any suitable materials and hardness. The components can also be coated as desired.

As shown in FIG. 4A, the capillary injection system 60 includes a capillary string S deployed from a wellhead 13. The capillary string S runs downhole and is banded or otherwise fastened to the exterior of production tubing T. A pump jack 11 located at the surface reciprocates a pump P downhole to lift hydrocarbons produced from the formation surrounding wellbore up the production tubing T.

The well has a casing C with perforations at a production zone. The production string T has threadably interconnected joints and extends from the wellhead 13 at the surface to the tubing anchor 100 and extends from there to the reciprocating rod pump P. Centralizers (not shown) as known to those of ordinary skill in the art can be used to keep the production tubing T centralized in the wellbore. For its part, the tubing anchor 100 anchors the production tubing T in the casing C and allows the production tubing T to be held in tension in the wellbore.

Below the tubing anchor 100, the sucker rod pump P is connected to a sucker rod string R extending through the production tubing T from the pump jack 10 at the surface. Reciprocation of the string R axially reciprocates the pump P to transport fluids from the formation through the production tubing T to the surface. Further downhole, the sucker rod pump P may have a perforated sub 70 and a bull plug. Desander injection ports can be used in this bottom sub 70 to control sand.

During production, hydrocarbons produced from the formation are lifted up to wellhead 13 through the interior of the production tubing T. As discussed above, it may be desirable to deal with detrimental materials, such as water, paraffin, salt and $H_2S$ from the wellbore or to deal with other production issues by pumping chemicals into the wellbore. To deliver the chemicals downhole to the pump P, a capillary string S connected to an injection source (not shown) at the surface passes through the wellhead 13 and is disposed on the exterior of production tubing T. An injection valve 80 on the distal end of the capillary string S can then be used to deliver injected chemicals to a targeted location in wellbore downhole of the anchor 100 and preferably adjacent the rod pump P, sub 70, etc.

Passing along the production tubing T, the capillary string S or a section thereof passes through the tubing anchor 100. In other words, the capillary string S extends from the wellhead 13, along the production tubing T, through the tubing anchor 100, and to the bottom end of the last section of production tubing T where the capillary string S connects to the injection valve 80. Along the tubing T, the capillary string S is preferably banded or otherwise fastened to the exterior of the production tubing T. Even below the tubing anchor 100, the capillary string S is preferably banded to the production tubing T.

Preferably, an upper section of the capillary string S connects to a section of capillary tubing 140 that has already been placed through the tubing anchor 100. In this arrangement, this pre-placed section of capillary tubing 140 can be connected to the uphole section as well as to a downhole section of capillary string S using a swage lock (not shown).

The tubing anchor 100 can be located within 40 feet up to several hundred feet above the bottom end of the capillary string S where the injection valve 80 is located. For its part, the injection valve 80 is located proximate the perforated sub 70 so that chemicals delivered from the valve 80 can readily be circulated uphole through the rod pump P and tubing T. The valve 80 may also typically located proximate perforations in the casing C. This valve 80 can be a spring loaded chemical injection valve. To mitigate flow back uphole through capillary string S, it is preferable that the injection valve 80 uses a check valve to prevent flow uphole through capillary string S.

The tubing anchor 100 and capillary string S allow operators to treat paraffin, corrosion, and scale buildups. For example, the tubing anchor 100 lets operators inject foamers, inhibitors, and other chemicals with precision below the anchor 100. The anchor 100 is set above the pump P and works in conjunction with the capillary string S to provide a chemical delivery system. The anchor 100 can be used in various casing sizes (e.g., 4½-, 5½- and 7-in. casing).

As shown, the capillary injection system 60 illustrated in FIG. 4A can be used in an oil and gas well in which a reciprocating type pump P is used to extract fluid from the wellbore. However, the capillary injection system 60 can be used with other systems, such as a progressive cavity pump system, a plunger lift system, or other system. In such arrangements, the injection valve 80 is preferably positioned adjacent the inlet to the production tubing T and is positioned so that substantially all of the chemicals exiting the valve 80 are circulated uphole by the production tubing T.

As noted above, the tubing anchor 100 allows a section of capillary tubing 140 to pass through the anchor 100 so all of the communicated chemicals can be delivered where needed. As shown in FIG. 4B, the tubing anchor 100 has a mandrel or tubular body 110 with upper and lower couplings 114 and 116 for connecting to the production tubing (T). Fixed supports 120*a-b* attached to the mandrel 110 hold the capillary tubing 140 to the mandrel 110. When the mandrel 110 couples to the production tubing T, the upper end of the tubing 140 connects to the section of capillary string (S) passing to the surface, and the lower end connects to another section of the string (S) passing to the injection valve (70) near the rod pump (P). Other arrangements are also possible.

An outer housing 150 is positioned on the mandrel 110 and holds a number of drag blocks or springs 152 and holds a number of slips 153. The one or more drag blocks or springs 152 assist in holding the tubing anchor 100 in the production tubing T, and they may help to centralize the anchor 100. The slips 153 are used to engage the casing. Finally, the mandrel 110 has a cone 130 affixed thereon a distance from the slips 153. Various shear screws 132 can be used to hold the cone 130 in place and can be designed to shear free under a predetermined load.

As alluded to above, the outer housing 150 can move on the mandrel 110 to engage the slips 153 against the cone 130, which causes the slips 153 to grip against surrounding casing. Rather than moving through multiple rotations of the production tubing and mandrel 110, the outer housing 150 moves on the mandrel 110 using a J-slot arrangement discussed in more detail below. Setting the tubing anchor 100 requires a ¼ turn, and unsetting the anchor 100 requires pick up above a threshold.

Figure 5A:
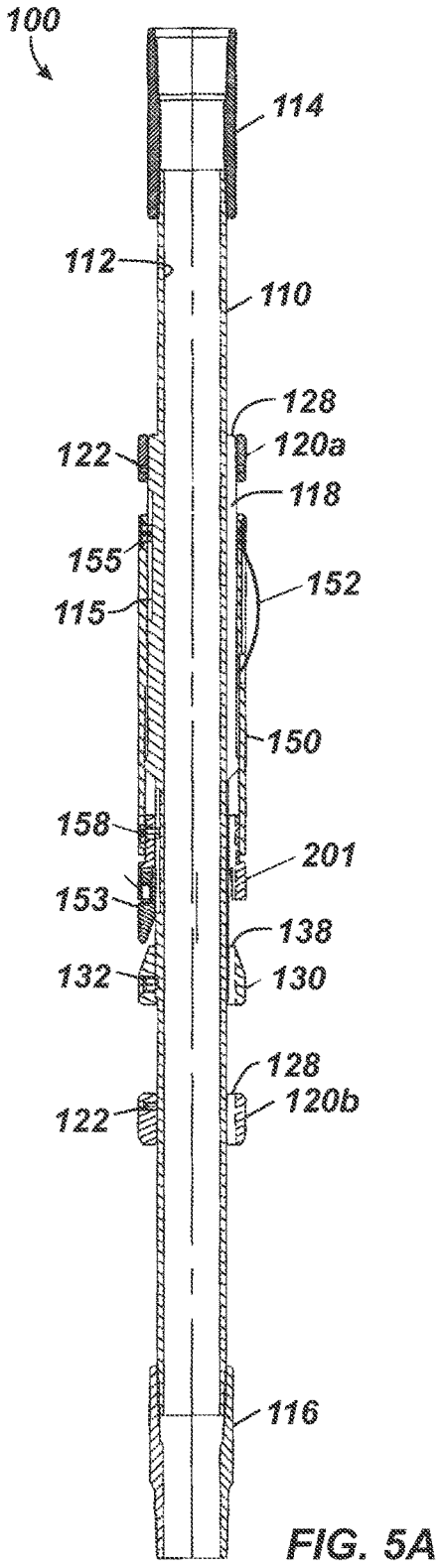
FIG. 5A illustrates a cross-sectional view of the disclosed tubing anchor.
Figure 5B:
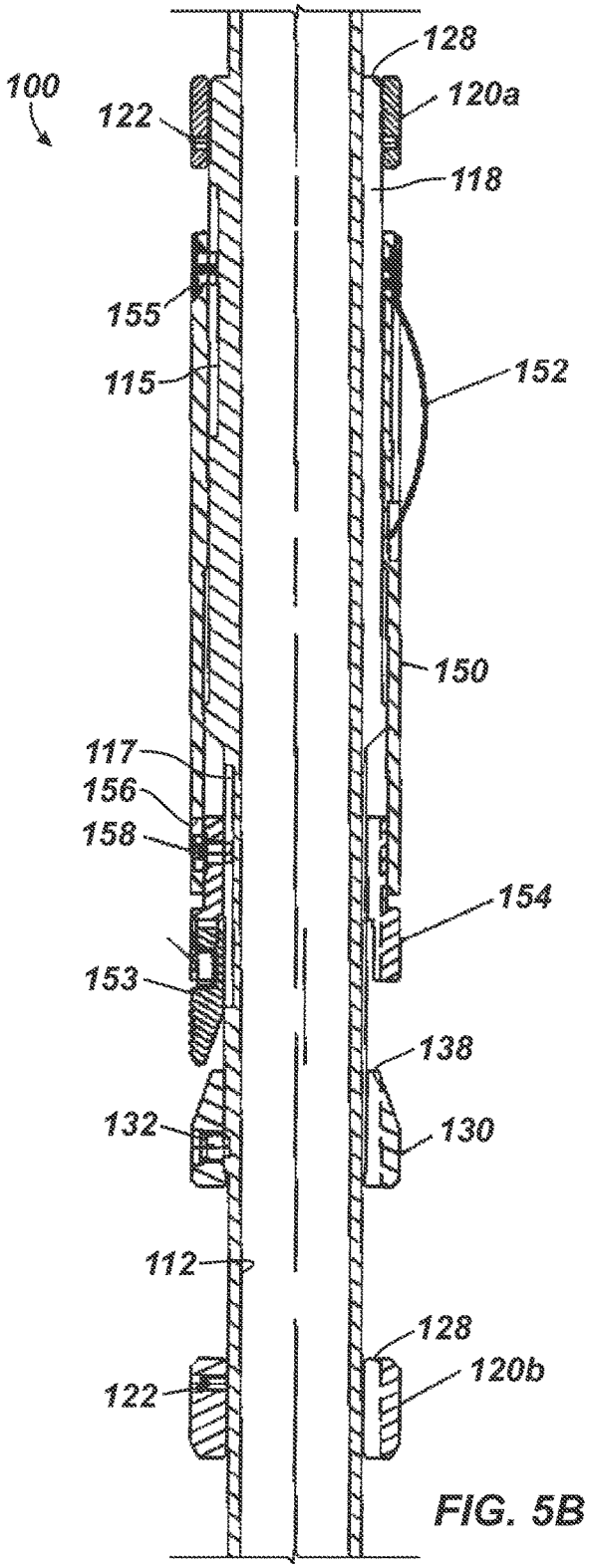
FIG. 5B illustrates the cross-sectional view of FIG. 5A in additional detail.

Turning now to the particulars of the tubing anchor 100, FIG. 5A illustrates a cross-sectional view of the disclosed tubing anchor 100, and FIG. 5B illustrates the cross-sectional view of FIG. 5A in additional detail.

As before, the tubing anchor 100 has the mandrel 110, the supports 120*a-b*, the cone 130, and the outer housing 150. The mandrel 110 is a tubular component that couples to the tubing string with couplings 114 and 116. The supports 120*a-b*, the cone 130, and the outer housing 150 are all disposed externally on the mandrel 110.

The mandrel 110 defines an inner bore 112 for conducting production fluid and for passage of the sucker rod. Details of the mandrel 110 are shown in a first cross-sectional view, a second cross-sectional view, and an end view of FIGS. 6A-6C. A projection of the outer surface of the mandrel 110 is best shown in FIG. 6D.

Externally, the mandrel 110 defines one or more J-slots 115*a-b*, slip slots 117, and a capillary groove 118 in the outer surface. As its name implies, the capillary groove 118 accommodates passage of the capillary string (140) or at least a segment thereof along an outside length of the mandrel 118. The groove 118, for example, may accommodate ¼" or ⅜" capillary injection tubing. In particular, the groove 118 on the mandrel 110 can accommodate two ¼-in. capillary lines together or can accommodate one ⅜-in. capillary line.

Figure 6D:
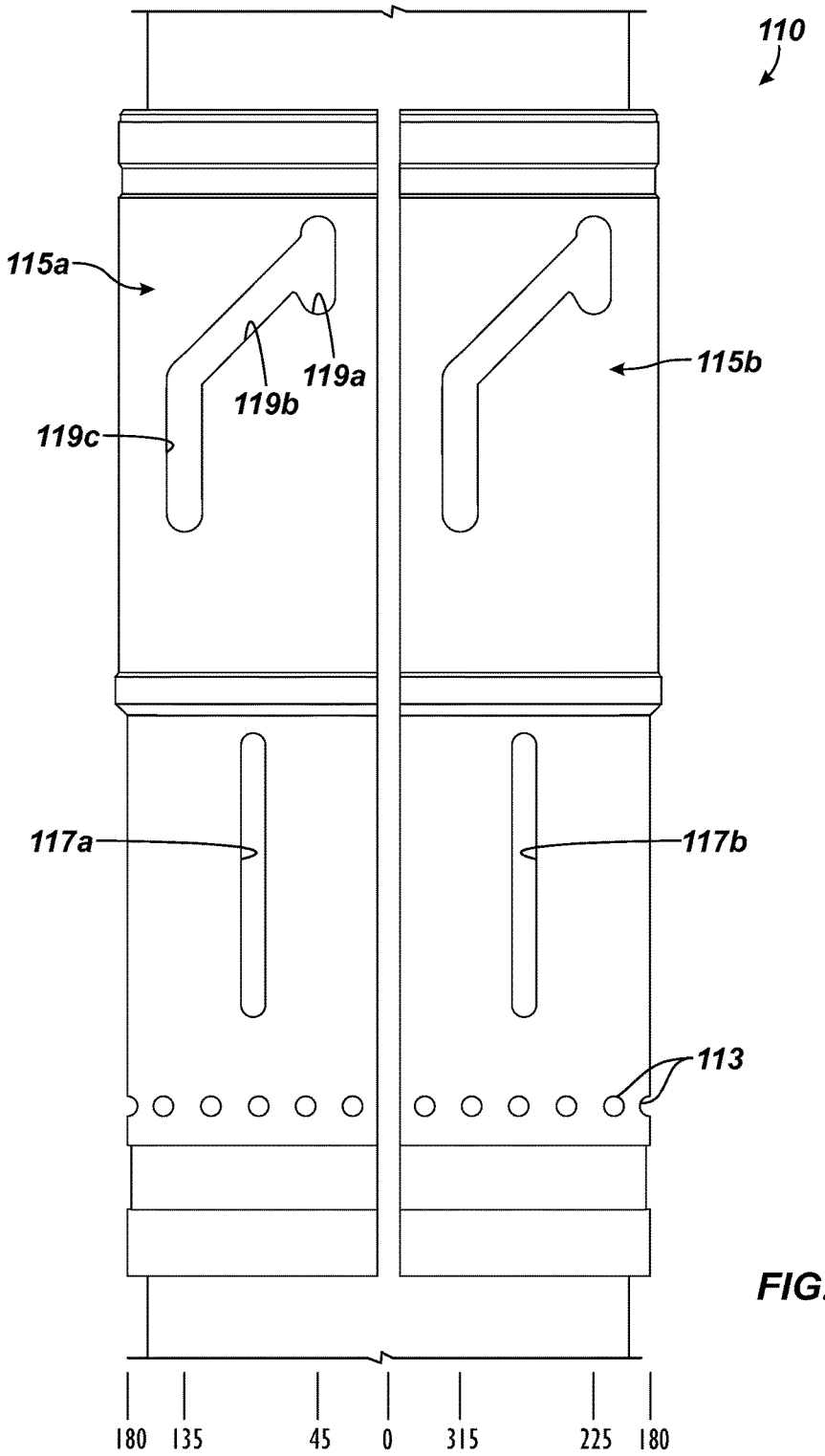
FIG. 6D illustrates a projection of the outer surface of the mandrel.

The J-slots 115*a-b*—two of which are shown in FIG. 6D—have an upper longitudinal catch 119*a*, an angled lateral section 119*b*, and a lower longitudinal section 119*c*. The slip slots 117*a-b*—two of which are shown in FIG. 6D—run longitudinally along the axial length of the mandrel 110. Although the slots 115*a-b* and 117*a-b* are shown on opposite sides of the mandrel 110 for balance, more or less slots 115*a-b* and 117*a-b* may be provided.

Ride pins 155 (FIGS. 5A-5B) on the housing 150 can ride in the J-slots 115*a-b* as the mandrel 110 is moved (axially and rotated ¼ turn) relative to the housing 150 during setting and unsetting procedures. Ride pins 158 (FIGS. 5A-5B) on the slip holder 154 can ride in the slip slots 117 as the mandrel 110 is moved (axially) relative to the slip holder 154 during setting and unsetting procedures. Details of these operations are provided later.

As best shown in FIGS. 5A-5B, the supports 120*a-b* are rings affixed on the mandrel 110 with fasteners 122 or the like to hold the capillary string (140) adjacent the mandrel 110. To accommodate the capillary string 140, the rings 120*a-b* may define internal grooves 128.

The cone 130 is also a ring disposed on the mandrel 110 toward a downhole end. The cone 130 affixes to the mandrel 110 with temporary connections, such as shear screws 132 or the like, in holes (113: FIG. 6D). The cone 130 also defines an internal groove 138 to accommodate the capillary string 140.

The housing 150 is a cylindrical sleeve or the like disposed on the mandrel 110 about the capillary groove 118. Details of the outer housing 150 are shown in the cross-sectional view and the end view of FIGS. 7A-7B. FIG. 7C is a detail of the outer housing 150 showing a groove 157 for a drag block spring (152). As best shown in FIGS. 5A-5B, the uphole end of the housing 150 has the ride pins 155 or other such features that can ride within the J-slots 115*a-b* on the exterior of the mandrel 110.

Figure 8A:
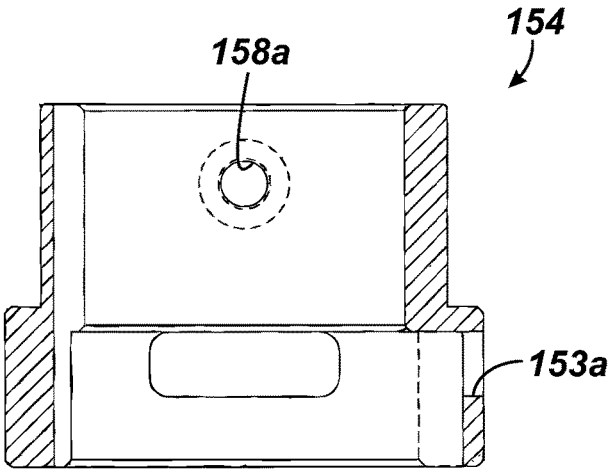
FIGS. 8A-8B illustrate a cross-sectional view and an end view of a slip holder for the disclosed tubing anchor.
Figure 9:
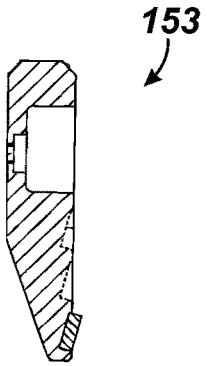
FIG. 9 illustrates a cross sectional view a slip for the disclosed tubing anchor.
Figure 8B:
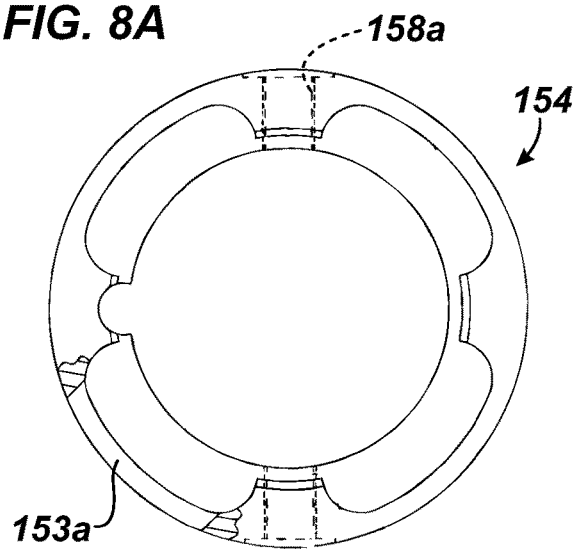

The downhole end of the housing 150 holds a slip holder 154 having a plurality of slips 153. Details of the slip holder 154 are shown in the cross-sectional view and the end view of FIGS. 8A-8B. FIG. 9 shows a slip 153 in a cross-sectional view. Briefly, the holder 154 has openings 158*a* for passage of ride pins (158: FIGS. 5A-5B) and has slots 153*a* for engaging ends of the slips 153.

As best shown in FIGS. 5A-5B, the housing 150 supports the slip holder 154 with ride pins 158. An inner end of the ride pins 158 ride in the longitudinal slots 117 along the mandrel 110, while an outer end of the ride pins 158 ride in a lateral slot 156 in the housing 150. (The feature of the lateral slot 156 in the housing 150 is best seen in the elevational view of FIG. 4B.) As discussed below, the housing 150 is movable on the mandrel 110 toward the cone 130 to move the slips 120 outward from the mandrel 110 to engage against the inside walls of the surrounding casing (not shown).

The tubing anchor 100 is a tension set anchor and is set with a ¼ turn to the left. This may equate to about 2 turns of the production tubing T at the surface to make the ¼ turn at the anchor 100. The anchor 100 has a safety release built into the cone 130. The safety release is field adjustable in 5000 lbf increments up to 55000 lbf using shear screws 132. The anchor 100 with its J-slots 115*a-b* also has an auto "J" when being released.

To install the tubing anchor 100, the capillary string S is banded to the production tubing T and is either feed through the anchor 100 or coupled to a section of tubing 140 on the anchor 100 as the case way be. Once ready, the anchor 100 is run to the setting depth. The stretch on the tubing T may be about +/−1.3 Ft per 1000'. Once at setting depth, operators pick up on the tubing T and hold left hand torque into the tubing T.

Operators then rotate ¼ turn to the left at the packer. While still pulling up, operators release the left hand torque once the ¼ turn has been made. Finally, operators continue picking up until there is at least 15000 lbf of tension in the anchor 100 at which point the tubing T can be landed in tension from the wellhead 13 using slip anchors, tubing hanger, or other wellhead component. In general, the anchor 100 is landed with at least 15000 lbf of tension.

As noted above, the ride pins 155 (FIGS. 5A-5B) on the housing 150 can ride in the J-slots 115*a-b* as the mandrel 110 is moved (axially and rotated ¼ turn) relative to the housing 150 during setting and unsetting procedures. During run in while the anchor 100 is unset, the ride pins 155 are situated in the lower end of the upper lateral catch 119*a* on the J-slots 115*a-b* (FIG. 6C). During setting and pulling tension on the tubing T, the ride pins 155 move along the lateral section 119*b* to the second longitudinal section 119*c* as the mandrel 110 moves a ¼ turn and axially relative to the housing 150 to engage the mandrel's cone 130 against the clips 153.

As also noted above, the ride pins 158 (FIGS. 5A-5B) on the slip holder 154 can ride in the slip slots 117 as the mandrel 110 is moved (axially) relative to the slip holder 154 during setting and unsetting procedures. The slip holder 154 thereby rotates with the mandrel 110 during the ¼ turn, but remains with the housing 150 as the mandrel 110 moves axially.

As can be seen by the installation process and the function of the ride pins 155 in the J-slots 115*a-b*, setting of the disclosed anchor 100 requires only moving the production tubing T a ¼ turn and axially to activate. The outer housing 150 does not turn with the tubing T and the mandrel 110.

There is a field adjustable safety release built into the anchor 100. For example, the cone 130 can accommodate up to 11 shear screws 132, with a shear value of 5000 lbf per screw 132. To actually unset the tubing anchor 100, operators set down on the anchor 100 with about 18-24" of tubing T. Operators then pull up on the anchor 100.

As the tubing T is pulled up, it is rotated a ¼ turn back to the right. Operators continue to pull up on the tubing T until the shear screws 132 on the cone 130 yield. This allows the cone 130 to fall away from the slips 153 to unset the anchor 100. As can be seen, the disclosed anchor 100 operates as an anchor only and not as an anchor and a catcher. In this sense, the disclosed anchor 100 can be set and released, but the disclosed anchor 100 is not intended to catch in the casing C.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An apparatus for delivering chemicals through a capillary string disposed along a production string in casing, the apparatus comprising:

a mandrel coupled to the production string and accommodating a portion of the capillary string outside thereof, the mandrel defining first and second slots, the first slot having a lateral portion extending laterally along the mandrel and having a first longitudinal portion extending longitudinally along the mandrel;

a housing disposed on the mandrel about the capillary string and engaged with the first slot; and a holder disposed on the housing and being rotatably coupled to the housing, the holder engaged with the second slot on the mandrel, the holder having a slip movable outward from the mandrel, wherein in an unset condition, the mandrel has a cone positioned away from the slip, and wherein in a set condition, the mandrel is first rotated to move laterally via the lateral portion of the first slot relative to the housing such that the holder having the slip is rotated with the mandrel relative to the housing via the rotatable coupling, and the mandrel is then shifted to move longitudinally via the first longitudinal portion of the first slot relative to the housing such that the holder having the slip is moved with the housing longitudinally via the second slot and the cone moves the slip outward against the casing.

2. The apparatus of claim 1, wherein the mandrel comprises a ring disposed thereon and supporting the portion of the capillary string on the outside of the mandrel.

3. The apparatus of claim 1, wherein the cone comprises a ring disposed on the mandrel with a breakable connection.

4. The apparatus of claim 3, wherein the ring defines a notch on an inside dimension accommodating passage of the portion of the capillary string.

5. The apparatus of claim 3, wherein the breakable connection comprises one or more shear screws affixing the ring to the mandrel.

6. The apparatus of claim 1, wherein the mandrel in the set condition is rotated less than a full turn in the lateral portion of the first slot relative to the housing.

7. The apparatus of claim 1, wherein the housing comprises an external drag member engaging the casing.

8. The apparatus of claim 1, wherein the housing defines a third slot extending laterally about the housing, the holder engaged with the third slot and movable laterally therein.

9. The apparatus of claim 1, wherein the first slot comprises a second longitudinal portion extending longitudinally along the mandrel, wherein the mandrel in the unset condition has the housing caught in the second longitudinal portion of the first slot and holds the cone away from the slip.

10. The apparatus of claim 9, wherein the lateral portion of the first slot interconnects the first and second longitudinal portions, wherein the mandrel rotates and further moves a longitudinal amount in the lateral portion to transition between the set and unset conditions.

11. The apparatus of claim 10, wherein the mandrel transitions between the set and unset conditions with less than a full turn of the mandrel.

12. The apparatus of claim 1, further comprising an injection valve disposed on a distal end of the capillary string downhole of the mandrel.

13. The apparatus of claim 1, further comprising a pump disposed on the production string downhole of the tubing anchor.

14. A lift system for a wellbore having casing, the system comprising:

a production string disposed in the casing and conducting produced fluid uphole;

a capillary string disposed along the production string and delivering chemicals downhole; and a tubing anchor disposed on the production string and anchoring the production string in tension in the casing, the tubing anchor at least including:

a mandrel coupled to the production string and accommodating a portion of the capillary string outside thereof, the mandrel defining a first slot and a second slot, the first slot having a lateral portion extending laterally along the mandrel and having a first longitudinal portion extending longitudinally along the mandrel, a housing disposed on the mandrel about the capillary string and engaged with the first slot;

a holder disposed on the housing and being rotatably coupled to the housing, the holder engaged with the second slot on the mandrel, the holder having a slip movable outward from the mandrel, wherein in an unset condition, the mandrel has a cone positioned away from the slip, and wherein in a set condition, the mandrel is first rotated to move laterally via the lateral portion of the first slot relative to the housing such that the holder having the slip is rotated with the mandrel relative to the housing via the rotatable coupling, and the mandrel is then shifted to move longitudinally via the first longitudinal portion of the first slot relative to the housing such that the holder having the slip is moved with the housing longitudinally via the second slot and the cone moves the slip outward from the mandrel against the casing.

15. The system of claim 14, further comprising an injection valve disposed on a distal end of the capillary string downhole of the tubing anchor.

16. The system of claim 14, further comprising a pump disposed on the production string downhole of the tubing anchor.

17. A method of delivering chemicals downhole of a tubing anchor on production string in casing, the method comprising:

running a capillary string along the production string past a slip of the tubing anchor, the tubing anchor having a mandrel, a housing, and a holder, the mandrel defining first and second slots, the housing disposed on the mandrel about the capillary string and engaged with the first slot, the holder disposed on the housing and being rotatably coupled to the housing, the holder engaged with the second slot on the mandrel and having the slip;

deploying the production string, the capillary string, and the tubing anchor into the casing;

moving the slip on the tubing anchor outward toward the casing by rotating the production string less than a full turn to move the mandrel laterally via the first slot relative to the housing such that the holder having the slip is rotated with the mandrel relative to the housing via the rotatable coupling and pulling tension on the production string to move the mandrel longitudinally via the first slot relative to the housing such that the holder having the slip is moved with the housing longitudinally via the second slot and the slip moves outward against the casing; and holding the production string in tension in the casing by setting the slip of the tubing hanger against the casing.

* * * * *